US010005479B2

(12) United States Patent
Shi et al.

(10) Patent No.: US 10,005,479 B2
(45) Date of Patent: Jun. 26, 2018

(54) ONLINE TRAIN WHEEL FAULT DETECTION DEVICE

(71) Applicant: NANJING TYCHO INFORMATION TECHNOLOGY CO., LTD., Nanjing, Jiangsu (CN)

(72) Inventors: Zhengying Shi, Jiangsu (CN); Zhilin Sun, Jiangsu (CN); Qichang Guo, Jiangsu (CN); Mingquan Huang, Jiangsu (CN)

(73) Assignee: NANJING TYCHO INFORMATION TECHNOLOGY CO., LTD., Nanjing, Jiangsu (CN)

( * ) Notice: Subject to any disclaimer, the term of this patent is extended or adjusted under 35 U.S.C. 154(b) by 200 days.

(21) Appl. No.: 14/903,552

(22) PCT Filed: Mar. 27, 2014

(86) PCT No.: PCT/CN2014/074153
§ 371 (c)(1),
(2) Date: Jan. 7, 2016

(87) PCT Pub. No.: WO2015/003510
PCT Pub. Date: Jan. 15, 2015

(65) Prior Publication Data

US 2016/0159378 A1 Jun. 9, 2016

(30) Foreign Application Priority Data

Jul. 10, 2013 (CN) ..... 2013 1 0287647

(51) Int. Cl.
*B61K 9/00* (2006.01)
*B61K 9/12* (2006.01)
*B61L 27/00* (2006.01)

(52) U.S. Cl.
CPC ..... *B61K 9/12* (2013.01); *B61L 27/0094* (2013.01)

(58) Field of Classification Search
CPC ..... B61K 9/12; B61L 27/0094
See application file for complete search history.

(56) References Cited

U.S. PATENT DOCUMENTS 4,802,285 A * 2/1989 Ligacz ..... B23B 5/28 33/203.11
4,932,784 A * 6/1990 Danneskiold-Samsoe ..... B61K 9/12 250/559.23

(Continued)

FOREIGN PATENT DOCUMENTS

CN 2823079 Y 10/2006
CN 202358130 U 8/2012
EP 2199735 A2 6/2010

OTHER PUBLICATIONS

Wang, Shujuan et al.; "Overview of Research Advances in Electromagnetic Acoustic Transducer"; Instrument Technique and Sensor; No. 5, May 31, 2006.

*Primary Examiner* — Jason C Smith
(74) *Attorney, Agent, or Firm* — Novick, Kim & Lee, PLLC; Allen Xue

(57) ABSTRACT

The present invention discloses an online fault detection device for train wheels, including: base rails 1, working rails 2, guard rails 3, and transducer detectors 4. A section is cut off from each of the symmetrically arranged base rails 1; a section of the working rail 2 transitions into and is attached to an outer side of the base rail 1 for bearing a train wheel; a section of the guard rail 3 transitions into and is attached to a position near an inner side of the base rail 1 for preventing a wheel rim from derailment; transducer detectors 4 and sensors thereof are placed in the space between working rail and guard rail; and the transducer detectors 4

(Continued)

A-A perform automated detection by connecting to a data collection and processing system such as an external computer. With the present invention, good detection effects, low cost, and quick detection of a fault can be achieved.

10 Claims, 3 Drawing Sheets

(56) References Cited

U.S. PATENT DOCUMENTS

| | | | | |
|---|---|---|---|---|
| 5,368,260 | A * | 11/1994 | Izbinsky | B61K 9/12 246/169 R |
| 5,577,690 | A * | 11/1996 | Haddox | B61K 9/12 246/169 R |
| 6,564,467 | B1 * | 5/2003 | Kay | B61K 9/12 246/169 R |
| 2014/0110534 | A1 * | 4/2014 | Bartonek | B61K 9/12 246/169 R |
| 2016/0031458 | A1 * | 2/2016 | Betancur Giraldo | B61K 9/12 73/146 |
| 2016/0101792 | A1 * | 4/2016 | Bartonek | B61K 9/06 701/20 |
| 2016/0103083 | A1 * | 4/2016 | Bartonek | B61K 9/04 701/19 |
| 2016/0159378 | A1 * | 6/2016 | Shi | B61K 9/12 246/169 R |

* cited by examiner

A–A

ONLINE TRAIN WHEEL FAULT DETECTION DEVICE

BACKGROUND

Technical Field

The present invention relates to a nondestructive train wheel fault detection technology, and in particular, to an online fault detection device for train wheels.

Background

Wheels are an important component of a running gear of a train. With the development of high speed, heavy load, and long routing of a railway, wheels are of great importance for safeguarding a safe operation of the railway. Currently, wheel fault detection is carried out mainly by manual operation or offline automatic wheel fault detection. The manual operation is carried out by one hand holding a fault detector and the other hand holding a probe, which suffers from low detection efficiency, long period, incomplete detection, and missing faults. Moreover, the offline automatic wheel fault detection requires detaching wheels to perform automatic detection, which has a heavy workload, and may easily damage the wheels. Currently, there are few, almost non-existent, studies on the train wheel fault detection technologies in China and overseas.

SUMMARY

Regarding common drawbacks and shortcomings in the existing train wheel detection technology, an objective of the present invention is to provide an online train wheel fault detection device that is of low costs and high detection efficiency.

An embodiment of the present invention provides an online fault detection device for train wheels, including: base rails 1, working rails 2, guard rails 3, and transducer detectors 4, where each of the base rails 1 has a section removed at the same location; a section of working rail 2 transitions into and is attached to an outer side of the base rail 1 for bearing a train wheel; a section of guard rail 3 transitions into and is attached to an inner side of the base rail 1 for preventing a wheel from derailment; and transducer detectors 4 and sensors thereof are placed in the space created between the working rail, and guard rail.

In the online fault detection device, a length of a fault detection area which is disposed in the space created by the working rail 2 and the guard rail 3 and the opening in the base rail 1 is greater than or equal to one to two times of a circumference of a wheel.

The transducer detector 4 is disposed in the fault detection area of the online device, and performs automated detection by connecting to a data collection and processing system such as an external computer.

In the online fault detection device, the surface of the guide rails 3 is elevated above the surface of the base rails 1 and the surface of the working rails so as to prevent a train wheel from derailment.

The online fault detection device of a train wheel is further characterized in that: distance W between the inner surfaces of the pair of symmetrically arranged working rails 2 is less than distance W1 between the outer surfaces of the pair of train wheels, and distance W2 between the pair of symmetrically arranged guard rails 3 is less than distance W3 between the inner surfaces of the pair of train wheels; the base rails 1 and the working rails 2 need to be transitionally connected, and end portions of the base rails 1 and the working rails 2 for the transitional connection need to be cut; and the base rails 1 and the guard rails 3 need to be transitionally connected, and the portion of the guard rail close to the base rail needs to be cut at the location where it transitionally connects with the base rail.

The present invention provides a train wheel detection device that comprises rails splice connected together, and therefore, the present invention has the following advantages:

1. A good detection effect is ensured: since the rails are splice connected together, an area between the working rail and the guide rail is in contact with a wheel tread, and functions as a fault detection area for reliably detecting a defective part;

2. Low cost is achieved: in the present invention, existing rails may be used without designing a dedicated rail so as to prevent a cost increase;

3. Quick detection of a fault can be achieved: when online fault detection is performed, a train may run forward and in reverse, over the detection working section to allow the completion of the detection work, and therefore, the entire process is convenient and quick; and 4. The base rails, the working rails, and the guide rails all need to be transitionally connected; the base rails and the working rails are cut to ensure a smooth transition of a detected wheel; to prevent a serpentine motion of a wheel, the end portions of the guide rails also need to be cut to prevent colliding with the wheels; and a later correction is performed.

The present invention may be widely used in detection of locomotives, coaches, multi-unit trains, high-speed trains, and the like.

DETAILED DESCRIPTION

The present invention is further illustrated below with reference to accompany drawings and embodiments.

Figure 1:
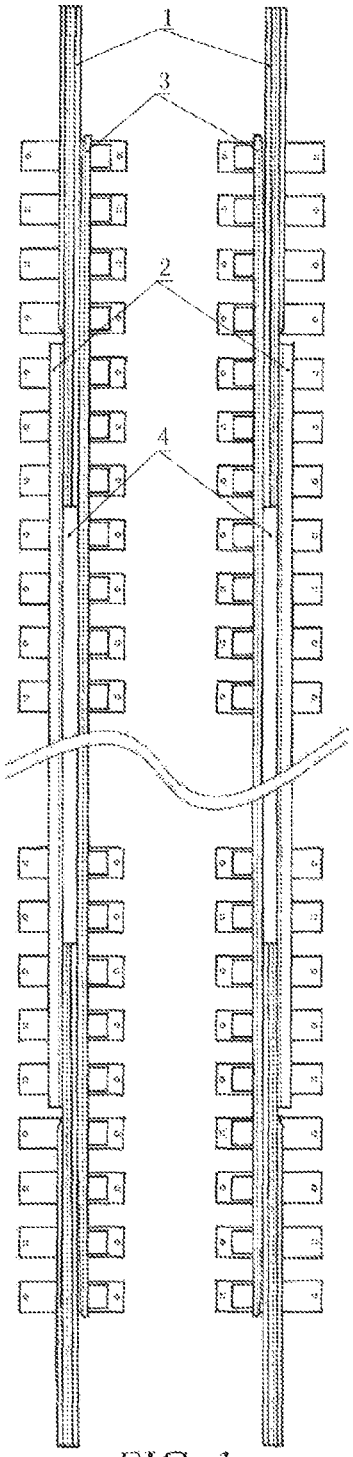
FIG. 1 is an overall schematic diagram of the present invention.

As shown in FIG. 1, when a train wheel rolls into a detection working section, the train wheel is transitioned from a state where a tread close to a wheel rim normally runs on a base rail 1 to a state where a tread surface far away from the wheel rim runs on a working rail 2, and an area between the tread surface close to the wheel rim and a guide rail 3 functions as a detection area that is in contact with a transducer detector 4.

In the online rail fault detection device, a section of base rail 1 is cut away at a position close to the detection section; an outer side of the base rail 1 is connected to a section of the working rail 2, and an inner side of the base rail is connected to an end of the guide rail 3; the transducer detector 4 is placed in a gap between the working rail 2 and the guide rail 3; the working rail 2 receives the wheel; and the guide rail 3 prevents the wheel rim from derailment.

The transducer detector 4 is used to detect defects inside the train wheel and the status of the tread, and automatically performs detection by connecting to a data collection and processing system such as an external computer.

The transducer detector 4 is disposed in the gap between the working rail 2 and the guide rail 3.

Figure 2:
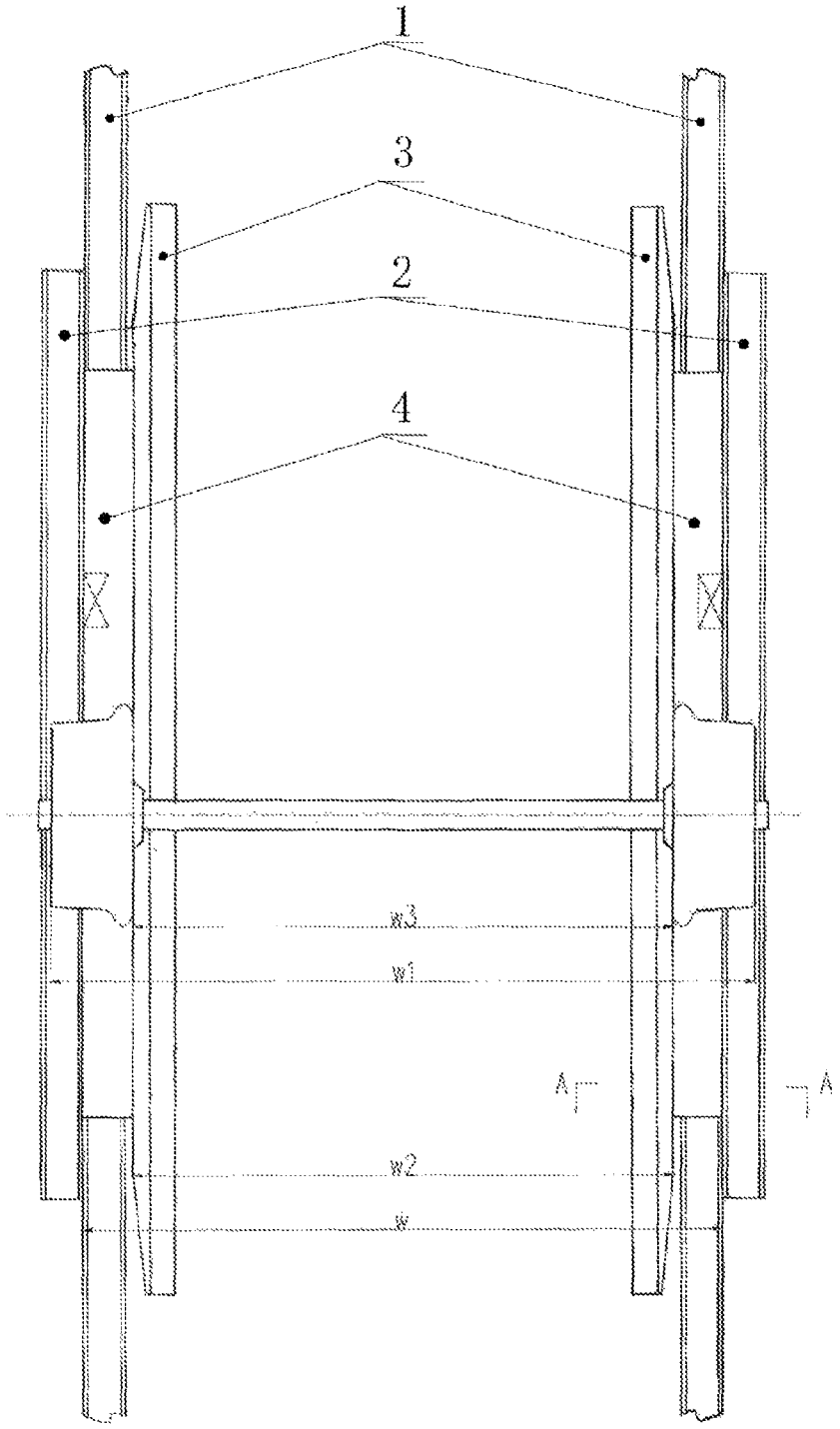
FIG. 2 is a schematic structural diagram of the present invention.
Figure 3:
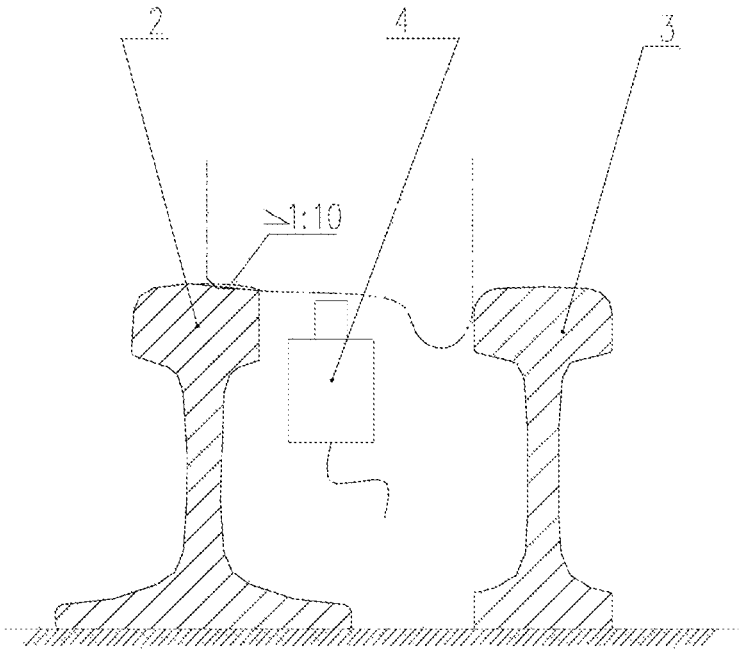
FIG. 3 is an A-A sectional diagram of the present invention, wherein 1 indicates base rails; 2 indicates working rails; 3 indicates guide rails; and 4 indicates transducer detectors.

As shown in FIG. 2, when a train wheel enters a detection working section, end portions of a working rail 2 and a guide rail 3 are cut to facilitate a smooth transition of the wheel train; distance W between the inner surfaces of the pair of working rails 2 is less than distance W1 between the outer surfaces of the pair of railway wheels, and distance W2 between the outer surface of the pair of the guard rails 3 is less than distance W3 between the inner surface the pair of the train wheels, so as to provide reliable detection space and facilitate installation and maintenance.

The working rails 2 and the guide rails 3 in the present invention are made by processing common rails, so as to meet a usage requirement of rails as well as substantially improve the stability and reliability of an entire structure, thereby achieving a long service life and low maintenance cost.

The embodiments above are only used to illustrate technical ideas of the present invention, and are not intend to limit the protection scope of the present invention. Any technical idea proposed according to the present invention and any variation made on the basis of the technical solutions fall within the protection scope of the present invention. Technologies not involved in the present invention can be implemented by using the prior art.

What is claimed is:

1. An online fault detection device for train wheels, comprising:

a pair of base rails, a pair of working rails, a pair of guard rails, and a plurality of transducer detector, wherein the base rails, the working rails, and the guard rails are symmetrically arranged; wherein a section in each of the symmetrically arranged base rails is cut off; a section of the working rail transitions into and is attached to an outer side of the base rail for bearing a train wheel; a section of the guard rail transitions into and is attached to an inner side of the base rail for preventing a wheel rim from derailment; and a plurality of the transducer detectors and sensors thereof are disposed in spaces of the spliced working rail and guard rail.

2. The online fault detection device for train wheels according to claim 1, wherein a length of a fault detection area formed between the working rail and the guard rail that are spliced to the cut-off of the base rail is greater than or equal to one to two times of a circumference of the train wheel.

3. The online fault detection device of a train wheel according to claim 1, wherein a rail surface of the guard rails is elevated above a rail surface of the base rails and a rail surface of the working rails.

4. The online fault detection rail device of train wheels according to claim 1, wherein a distance (W) between two inner surfaces of the symmetrically arranged working rails is less than a distance (W1) between the outer surfaces of a pair of train wheels, and an distance (W2) between the outer surfaces of the symmetrically arranged guard rails is less than a distance (W3) of the inner surface of the train wheels.

5. The online fault detection rail device of train wheels according to claim 1, wherein the base rails and the working rails are transitionally connected, and two end portions of the base rails and the working rails for transitional connections are cut; and the base rails and the guard rails are transitionally connected, and a portion of the guard rails close to the base rails is cut.

6. The online fault detection rail device of a train wheel according to claim 1, wherein the working rails and the guard rails are all made by processing common rails.

7. The online fault detection device of a train wheel according to claim 2, wherein a rail surface of the guard rails is elevated above a rail surface of the base rails and a rail surface of the working rails.

8. The online fault detection rail device of train wheels according to claim 2, wherein a distance (W) between two inner surfaces of the symmetrically arranged working rails is less than a distance (W1) between the outer surfaces of a pair of train wheels, and an distance (W2) between the outer surfaces of the symmetrically arranged guard rails is less than a distance (W3) of the inner surface of the train wheels.

9. The online fault detection rail device of train wheels according to claim 2, wherein the base rails and the working rails are transitionally connected, and two end portions of the base rails and the working rails for transitional connections are cut; and the base rails and the guard rails are transitionally connected, and a portion of the guard rails close to the base rails is cut.

10. The online fault detection rail device of a train wheel according to claim 2, wherein the working rails and the guard rails are all made from processing common rails.

* * * * *